US012571269B2

(12) United States Patent
Knobloch, Jr.

(10) Patent No.: US 12,571,269 B2
(45) Date of Patent: Mar. 10, 2026

(54) FLUID CONDITIONING AND/OR TREATMENT SYSTEM

(71) Applicant: Mason Specialty Tools, L.L.C., Scott, LA (US)

(72) Inventor: Benton T. Knobloch, Jr., Lafayette, LA (US)

(73) Assignee: MASON SPECIALTY TOOLS, LLC, Scott, LA (US)

( * ) Notice: Subject to any disclaimer, the term of this patent is extended or adjusted under 35 U.S.C. 154(b) by 53 days.

(21) Appl. No.: 18/100,905

(22) Filed: Jan. 24, 2023

(65) Prior Publication Data

US 2023/0235650 A1 Jul. 27, 2023

Related U.S. Application Data

(60) Provisional application No. 63/302,297, filed on Jan. 24, 2022.

(51) Int. Cl.
*E21B 21/00* (2006.01)
*E21B 27/00* (2006.01)
*E21B 43/08* (2006.01)

(52) U.S. Cl.
CPC ..... *E21B 21/002* (2013.01); *E21B 27/005* (2013.01); *E21B 43/086* (2013.01)

(58) Field of Classification Search
CPC .... E21B 21/002; E21B 21/003; E21B 43/086; E21B 27/005; E21B 27/00; E21B 34/105; E21B 31/06
See application file for complete search history.

(56) References Cited

U.S. PATENT DOCUMENTS

| | | | | |
|---|---|---|---|---|
| 6,138,757 | A * | 10/2000 | Latos | E21B 21/14 166/265 |
| 6,176,311 | B1 * | 1/2001 | Ryan | E21B 31/06 166/99 |
| 6,655,462 | B1 * | 12/2003 | Carmichael | B08B 9/0553 166/99 |
| 10,053,960 | B2 | 8/2018 | Romero et al. | |
| 10,648,256 | B2 | 5/2020 | Romero et al. | |
| 10,677,019 | B2 | 6/2020 | Romero et al. | |
| 2010/0243258 | A1 * | 9/2010 | Fishbeck | E21B 31/06 166/105.1 |
| 2014/0116681 | A1 * | 5/2014 | Broussard | E21B 27/005 166/227 |
| 2015/0075799 | A1 * | 3/2015 | Wilson | E21B 21/103 166/311 |
| 2019/0063170 | A1 * | 2/2019 | Romero | E21B 37/045 |
| 2019/0377992 | A1 * | 12/2019 | Hrupp | G06K 19/0723 |
| 2021/0115746 | A1 * | 4/2021 | Atkins | E21B 21/002 |

* cited by examiner

*Primary Examiner* — George S Gray
(74) *Attorney, Agent, or Firm* — LAW OFFICE OF JESSE D. LAMBERT LLC

(57) ABSTRACT

A fluid conditioning and/or treatment system is disclosed. A bell housing with a pressure relief element, for example a rupture disk, has an external shoulder to seat within a tubular. One or more filter chambers, with slots in the walls thereof, are releasably connected to the bell housing. A magnet mandrel is attached to the lowermost filter chamber. Fluids, for example drilling/completion fluids, are pumped downhole through the apparatus, and the filter chamber(s) and magnet remove solids and ferrous materials from the fluid stream. Threaded connections and connectors create a modular system, with the various elements easily changed out.

6 Claims, 9 Drawing Sheets

FLUID CONDITIONING AND/OR TREATMENT SYSTEM

CROSS REFERENCE TO RELATED APPLICATIONS

This non-provisional United States Patent application claims priority to U.S. provisional patent application Ser. No. 63/302,297, filed Jan. 24, 2022, for all purposes. That provisional patent application is incorporated herein by reference, to the extent not inconsistent with this application.

BACKGROUND-FIELD OF THE INVENTION

Various apparatus and methods have been developed to condition and/or treat fluids flowing through a tubular bore. Generally, such apparatus are positioned in a fluid flowpath in the bore of a tubular, with fluids passing through and around the apparatus, as the fluids travel down the tubular bore.

SUMMARY

The fluid conditioning and/or treatment system embodying the principles of the present invention fundamentally comprises one or more connected sections, which may be retrievably disposed in the bore of a tubular through which fluids flow. It is to be understood that the fluid conditioning and/or treatment system may be positioned in the bore of any form of tubular through which fluids flow, including but not limited to tubulars disposed in the borehole of a well (e.g., drillpipe, workstrings, tubing of any form); pipelines; flowlines; and any other form or configuration of tubular through which fluids flow.

It is understood that the system may be described as having an "uphole" and a "downhole" end, which are noted in the attached drawings; fluid flows through the system from the uphole end to the downhole end. As is readily known in the relevant art, when the system is positioned in a tubular in a wellbore, the uphole end is that end closest to the earth's surface, while the downhole end is that end closest to the bottom of the wellbore.

The connected sections may be any desired combination of filter chambers, magnets, diffusers, junk chambers, etc. or any other form of fluid conditioning and/or treating apparatus. Threaded connectors and connections result in modularity of the tool, with different sections easily added, removed, and/or replaced.

In one exemplary embodiment, as shown in the drawings, the fluid conditioning and/or treatment system has a bell housing attached to an uphole end of a first element, which may be a filter chamber. The bell housing has an external tapered shoulder adapted to engage a mating internal shoulder within a tubular bore when the filter system is in place within the tubular bore. The first filter chamber, by way of example, may be an elongated cylinder with holes or slots in the cylinder wall, through which fluids can be pumped, the fluids passing from the interior or bore of the cylinder to the exterior of same, into the annulus between the filter chamber and the tubular within which it is run. The bell housing preferably has a pressure relief component, which may be a rupture disk, a shear pin arrangement, or other suitable component.

The bell housing and the filter chamber are preferably connected by a threaded connection. If desired, additional filter chambers may be attached together by threaded connections and connectors.

A magnet section may be connected to the lowermost filter chamber. The magnet section, in one embodiment, has a plurality of elongated magnets longitudinally positioned on its outer surface, and preferably has a non-magnetic sleeve covering said magnets. Finally, a bottom element may be attached to a lowermost end of the magnet section, which holds the sleeve in place and provides centralization.

A flow dispersion element, namely a flow dispersion cone, having a cone-shaped uphole end may be placed in the lowermost filter chamber. The flow dispersion element diverts fluid flow radially outward at an angle. Preferably, the slots in the filter chamber walls have a downhole surface which is also angled in a downhole direction, as viewed from an uphole direction to a downhole direction, which generally corresponds to the angle of fluid flow created by the flow dispersion element, eliminating 90 degree fluid flow direction changes.

In another embodiment, especially suitable for small diameter tubulars, the topmost element (corresponding to the bell housing as described above) may be referred to as a flange. A retrieval element seats within the flange, with an exterior shoulder on the retrieval element resting on an internal shoulder within the flange. A shear element, which can be shear pins, connect the flange and the retrieval element. The remaining components (filter chambers, etc.) connect, via a threaded connection, to the downhole end of the retrieval element and extend downhole. The retrieval element comprises an internal profile, in which a fishing tool can latch. In the event that the filter chambers plug, a fishing tool can be deployed downhole, latch into the internal profile, and with sufficient tension shear the shear elements and retrieve the retrieval element and the connected filter chambers, etc. from the borehole.

BRIEF DESCRIPTION OF THE DRAWINGS

It is to be understood that the attached figures disclose one possible embodiment of and apparatus embodying the principles of the fluid conditioning and/or treatment.

DESCRIPTION OF THE PRESENTLY PREFERRED EMBODIMENT(S)

While various fluid conditioning and/or treatment systems can embody the principles of the present invention, with reference to the drawings some of the presently preferred embodiments can be described.

It is to be understood that apparatus embodying the principles of the present invention comprise, generally, one or more components connected to a bell housing, the bell housing held in a top ring positioned in the bore of a tubular through which fluids flow. Connectors permit connection of various desired system elements, including but not limited to filter chambers, magnets, and any other fluid conditioning and/or treatment elements in any desired sequence along the length of the apparatus. The bell housing has a pressure relief component (which may be a rupture disk, or similar component) in the event that the filter chamber(s) become plugged by debris; in that event, sufficient fluid pressure opens the pressure relief component, permitting fluid circulation until the apparatus is retrieved from the tubular bore; also, in settings in which the apparatus is disposed downhole in the bore of a tubular string in a wellbore, fluid flow through the opened pressure relief component permits fluid to drain from the tubular string as it is pulled from the wellbore, preventing retrieval of a so-called "wet string." In another embodiment, a fishing tool can be deployed to latch into a retrieval element, shear the shear elements and retrieve the filter chambers, etc. from the wellbore.

It is understood that the fluid conditioning and/or treatments system apparatus may be disposed in the bore of any tubular through which fluids flow, including but not limited to tubulars disposed in the borehole of a well (e.g., drillpipe, workstrings, tubing of any form); pipelines; flowlines; and any other form or configuration of tubular through which fluids flow.

In one embodiment, in which the system is used in conjunction with oil/gas well drilling and/or servicing applications, fluids flow through and/or around the elements of the system, and (for example) solids are filtered out and held within the filter chambers. In addition, ferrous particles small enough to pass through the filter chamber openings may be captured by a magnet. As noted above, other elements may be provided, which may perform other treatment and/or conditioning of the fluids.

Figure 1:
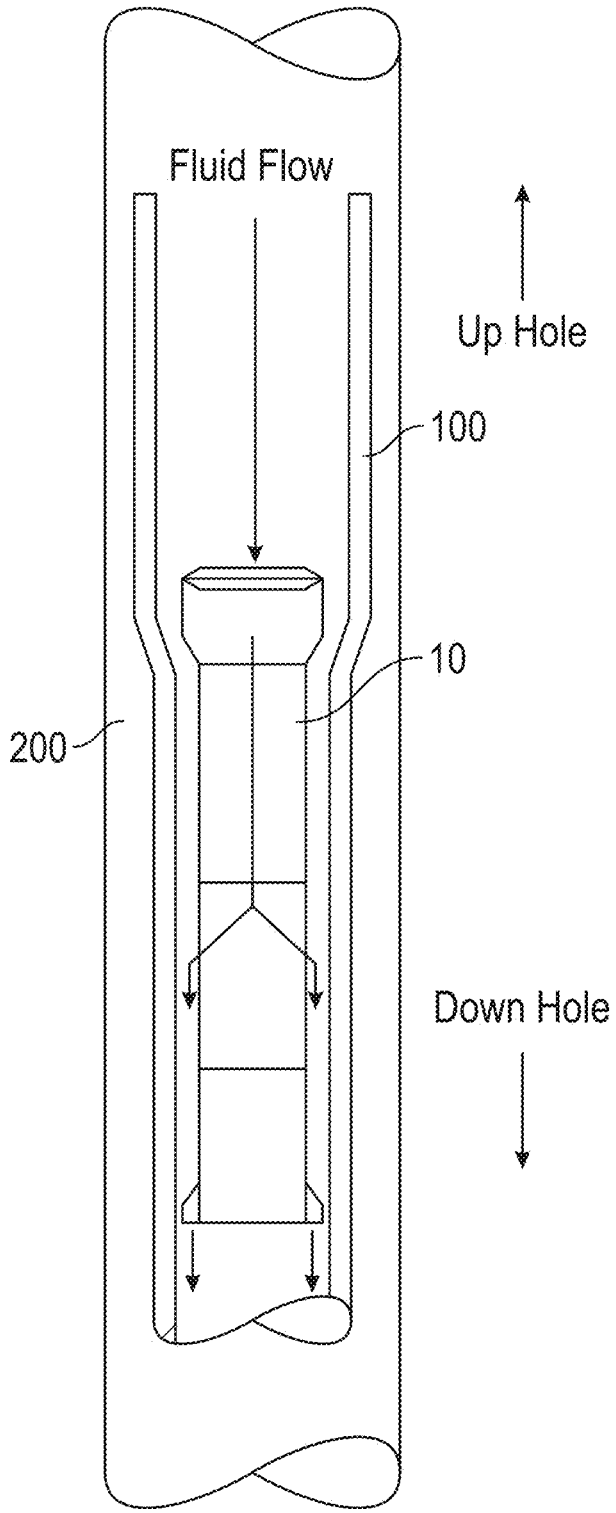
FIG. 1 is a general view of the fluid conditioning and/or treatment apparatus of the present invention, in position within a tubular in a wellbore.

FIG. 1 is a drawing showing, in schematical form, the general placement of the filter conditioning and/or treatment system apparatus 10 within a tubular 100, within a borehole 200. Uphole and downhole directions, when the apparatus is positioned in a tubular, are noted. In other applications, for example with the apparatus positioned in a pipeline, "uphole" will be understood as "up-current" or "up-flow," and "downhole" as "down-current" or "down-flow."

Figure 2:
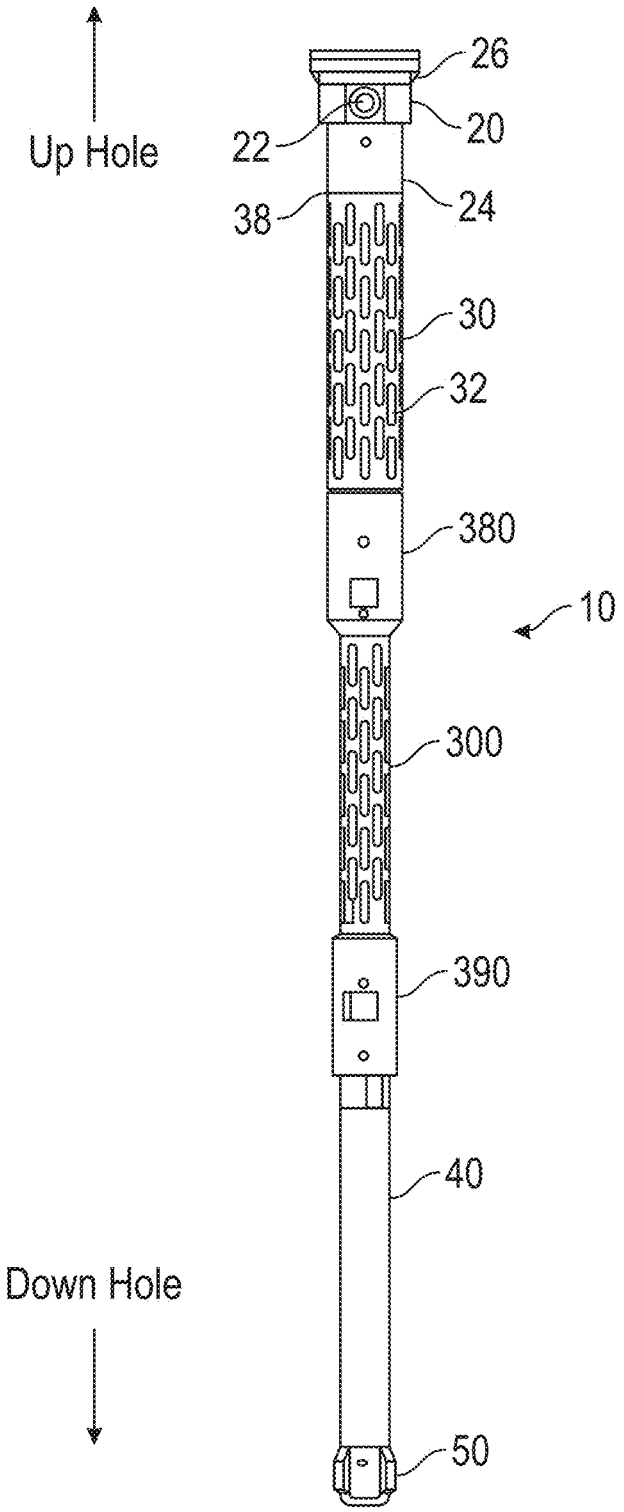
FIG. 2 is a side view of the apparatus.
Figure 3:
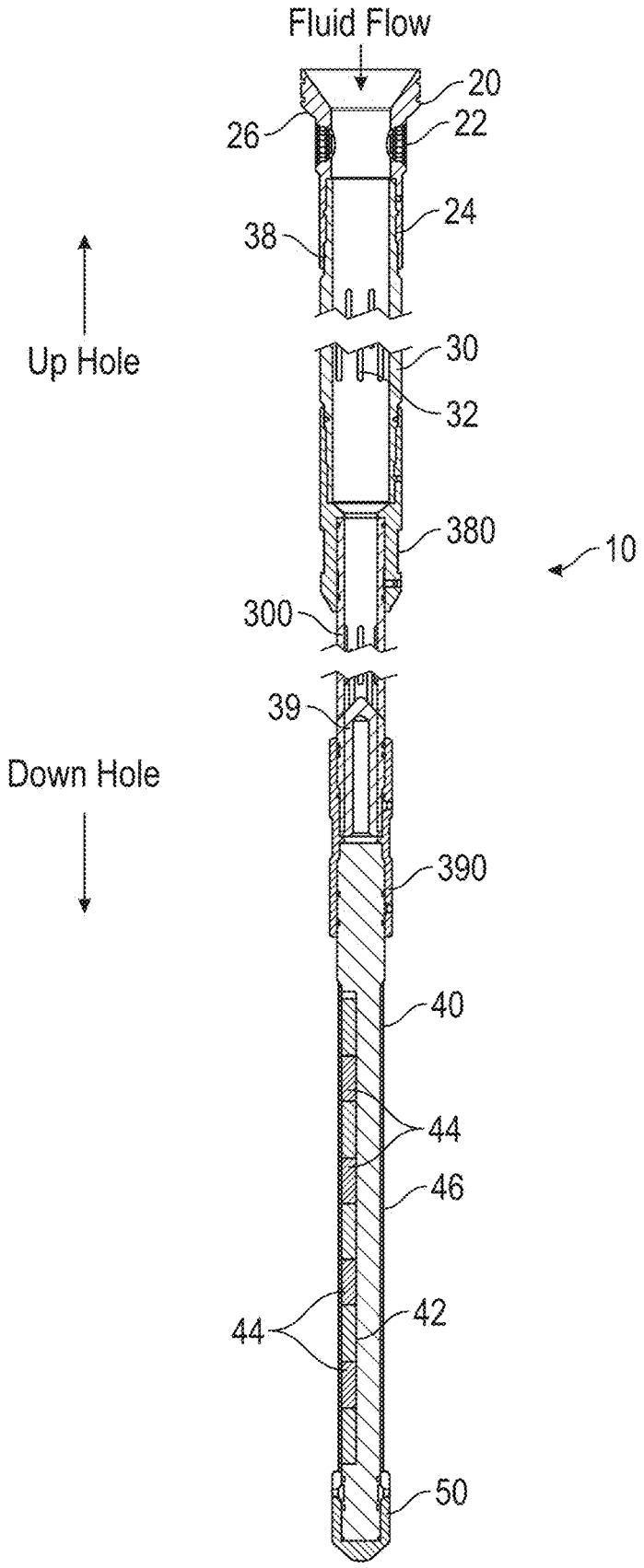
FIG. 3 is a side view of the apparatus in more detail.

FIGS. 2 and 3 shows apparatus 10 in more detail. Starting at the uphole end, apparatus 10 comprises a bell housing 20. Bell housing 20 preferably comprises an external tapered shoulder 26, which may comprise a desired profile. A pressure relief component 22, which may comprise a rupture disk or other similar component, is positioned in bell housing 20. Preferably, the downhole end of bell housing 20 comprises a threaded connection 24.

A first element, which may be a filter chamber 30, releasably connects to the downhole end of bell housing 30 by a threaded connector 38. Filter chamber 30 is generally an elongated cylinder in form, and preferably comprises a plurality of openings or slots 32 in the wall of filter chamber 30. Fluids pumped down tubular 100 flow through bell housing 20, into an interior of filter chamber 30, and outward through slots 32 into the annulus between filter chamber 30 and borehole 200 (which may be a cased or open borehole). Diffuser blades (seen in FIG. 6) 34 may be positioned in filter chamber 30, such that diffuser elements extend into the interior of filter chamber 30. Diffuser blades 34, in one embodiment, are longitudinally positioned plates. Diffuser blades 34 assist in breaking up any larger size solids in the flowstream.

A connector 380 connects second element, which may be second filter chamber 300, to first filter chamber 30. It is understood that any number of filter chambers may be connected together in series. Typically, but not necessarily, second filter chamber 300 would be of a smaller outer diameter than first filter chamber 30. Another connector means 390 connects third element, which may be magnet mandrel 40, to filter chamber 30, filter chamber 380, or if desired directly to bell housing 20. Finally, another connector means 50 attaches to the downhole end of magnet mandrel 40. Connector 50 may also be dimensioned to provide a centralization function. It is understood that connector 50 may be attached to the downhole end of a filter chamber, if no magnet mandrel is being run.

Filter conditioning and/or treatment system apparatus 10 is installed as a tubular string is run into a wellbore, with shoulder 26 seating in a tubular (which may be a special pup joint, or may be simply a joint of tubing, drill pipe, etc.), and may be held in place by the pin of a tubular connection, as shown in FIG. 1. Pressure relief component 22 (which may comprise a rupture disk or other similar component) is provided in bell housing 20, so that pressure relief component can be opened by fluid pressure and fluid circulation maintained, if the filter chambers plug. The downhole end of bell housing 20 preferably comprises a threaded connection 24. Bell housing 20 may comprise suitable profiles for O-rings or other sealing elements, as desired.

Figure 4:
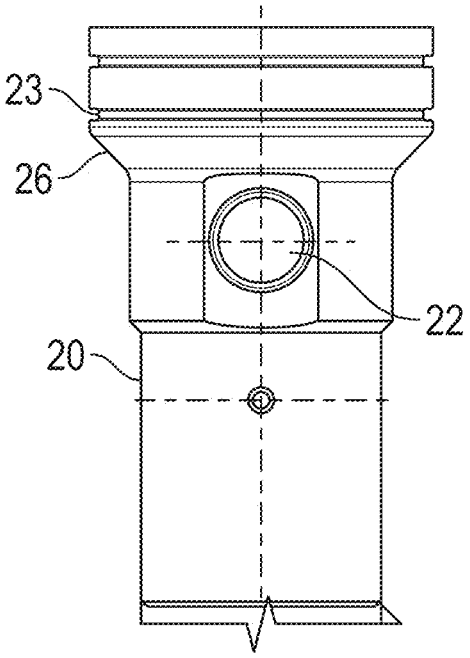
FIGS. 4 and 5 are side and cross section views of the bell housing.
Figure 5:
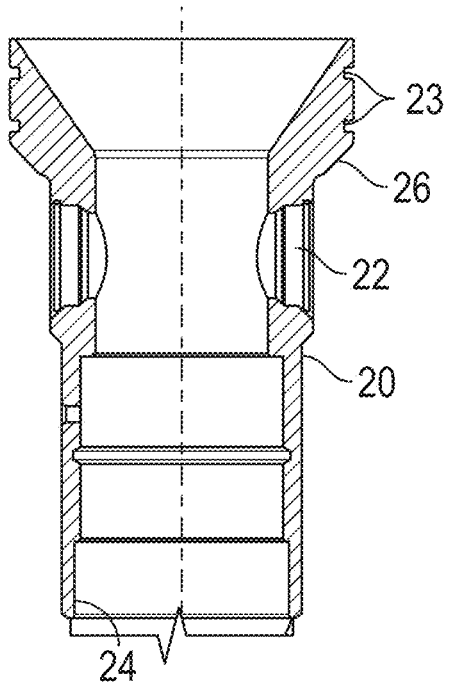

FIGS. 4 and 5 show more detail of bell housing 20. As previously noted, bell housing 20 has a bore 21 therethrough, through which fluids flow. External tapered shoulder 26 seats in an appropriate profile within tubular 100. Grooves or recesses 23 may be provided for seal elements. A pressure relief component 22, which may be a rupture disk, is provided. Downhole end of bell housing 20 preferably comprises a threaded connection 24.

Figure 6:
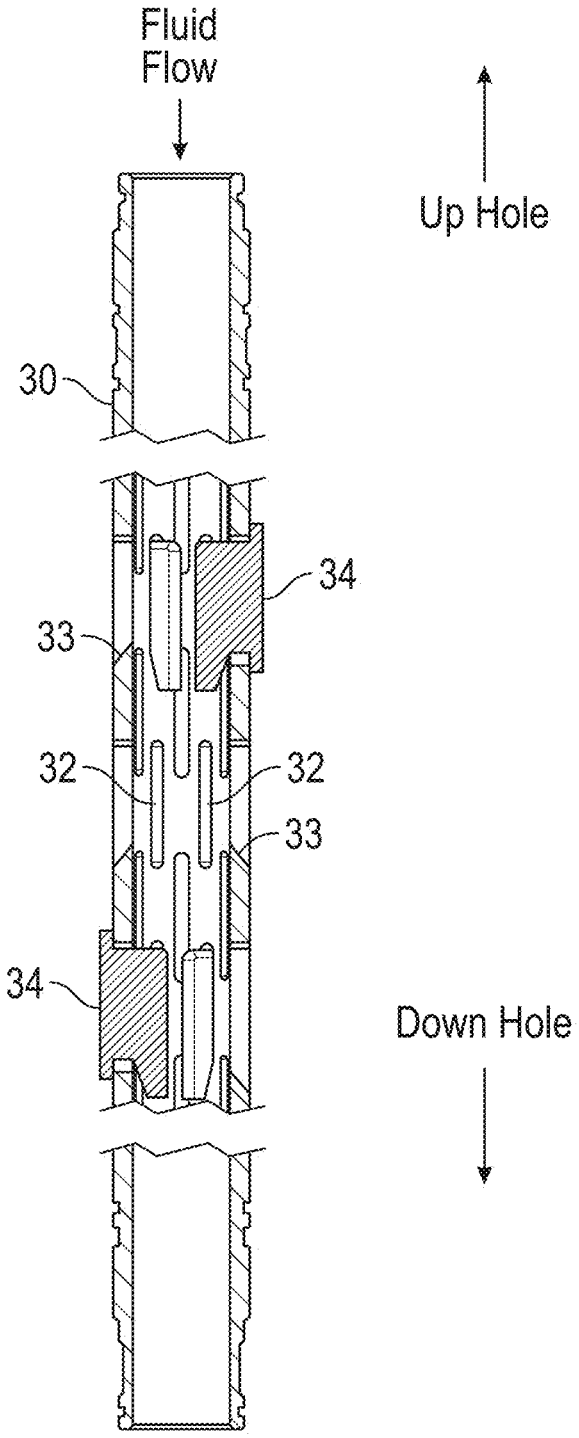
FIGS. 6 and 7 are cross section and side views of an exemplary filter chamber.
Figure 7:
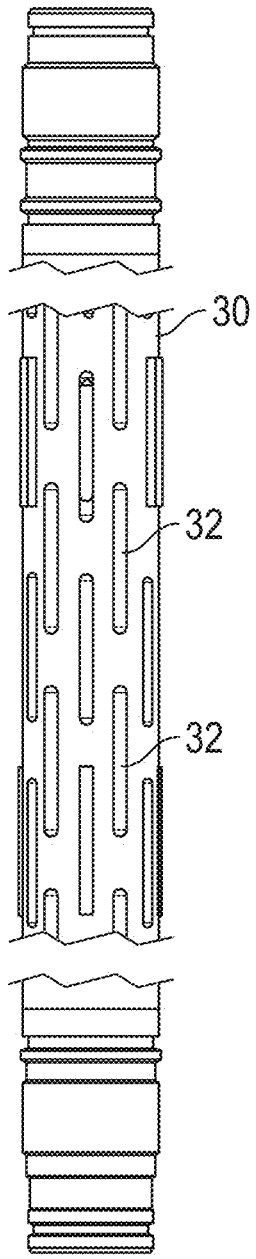

Referring to FIGS. 6 and 7, filter chamber 30 is generally cylindrical and has openings in its wall, for example holes or slots 32 as pictured, so that fluids can flow through the apparatus but solids (too large to pass through slots 32) are captured within the filter chamber. In a preferred embodiment, and as shown in FIG. 6, diffuser blades 34 are positioned within the bore of filter chamber 30, thereby within the fluid flow path within filter chamber 30. Diffuser blades 34 assist in breaking up any larger solids in the flowstream.

It is understood that a second filter chamber 300, of similar structure to filter chamber 30, may be connected to the downhole end of filter chamber 30, by threaded connections/threaded connector.

Figure 8:
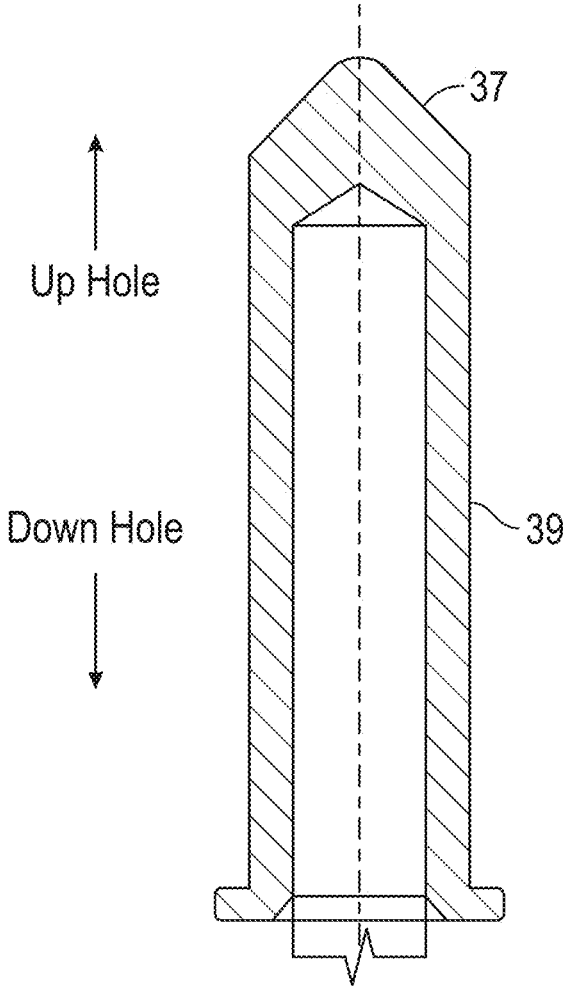
FIGS. 8 and 9 are cross section and side views of the flow disperser cone element.
Figure 9:
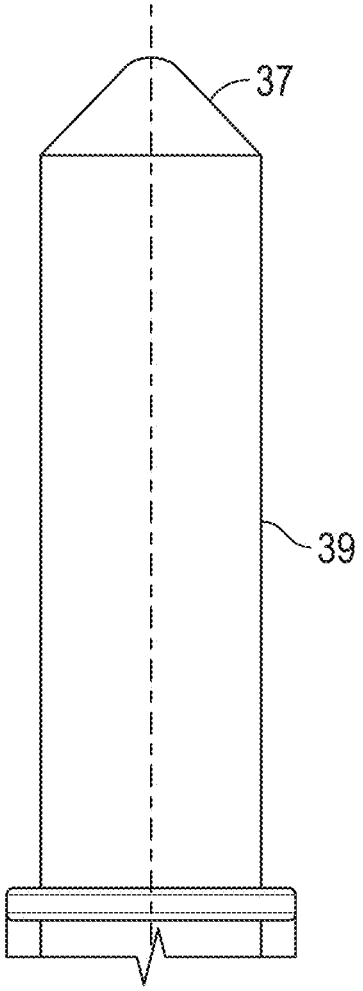
Figure 10:
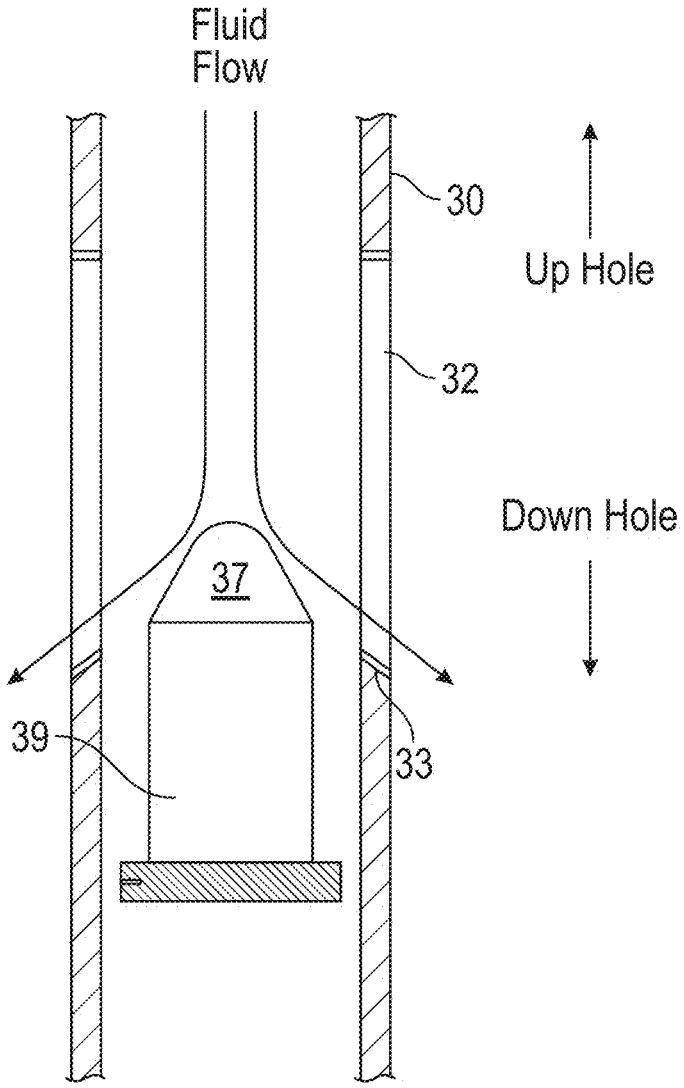
FIG. 10 is a view of the flow disperser cone element within a filter chamber, showing fluid flow direction.

As can be seen in FIG. 3, and in detail in FIGS. 8 and 9, preferably, a flow disperser cone element 39 is positioned within the elongated cylinder of the lowermost filter chamber. As can be seen, flow disperser cone element 39 has a top cone 37 on its uphole end. Preferably, as can be seen in FIG. 6, slots 32 have an angled surface 33 on their downhole end, angled in a downhole direction from the inner wall of the elongated cylinder of filter chamber 30 to the outer wall of the elongated cylinder of filter chamber 30 (namely, the annulus surrounding filter chamber 30. As can be seen in FIG. 10, the combination of flow disperser cone element 39, and the angled downhole surface of slots 32, guide fluid flow out of the bore of filter chamber 30 to the annulus, avoiding 90 degree changes in fluid flow direction.

Figure 11:
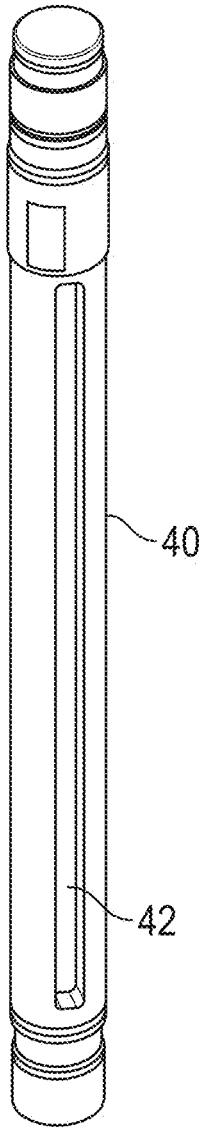
FIG. 11 is a view of the magnet mandrel.
Figure 13:
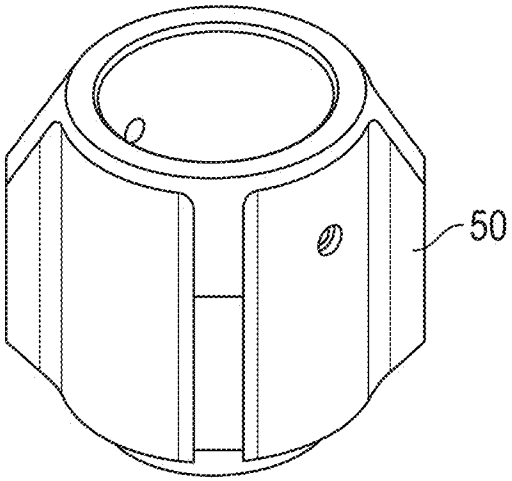
FIGS. 12 and 13 are cross section and perspective views of the bottom connector.

Referring to FIG. 3, the downhole end of the lowermost filter chamber (which may be a first, second, etc.) comprises a threaded connection. A connector 390 joins filter chamber 30 to magnet mandrel 40. In a preferred embodiment, magnet mandrel 40 (shown in more detail in FIG. 11) comprises a plurality of longitudinal slots 42, in which are positioned magnets 44. A non-magnetic sleeve 46 (which may be a stainless steel sleeve or the like) slides over magnet mandrel 40 and holds magnets 44 in place.

As shown in FIG. 3, and in more detail in FIGURES a connector 50 is attached to the downhole end of magnet mandrel 40, holding sleeve 46 in place and preferably dimensioned so as to provide a centralization function. Connector 50 has fluid flow passages as required.

Another Embodiment

Figure 15:
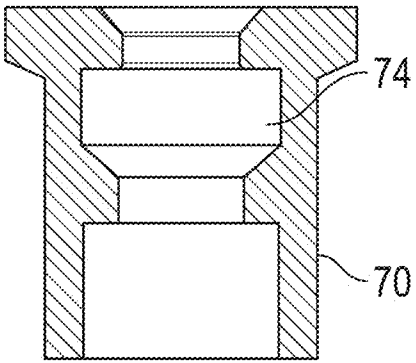
FIG. 15 is a cross section view of the retrieval element.
Figure 12:
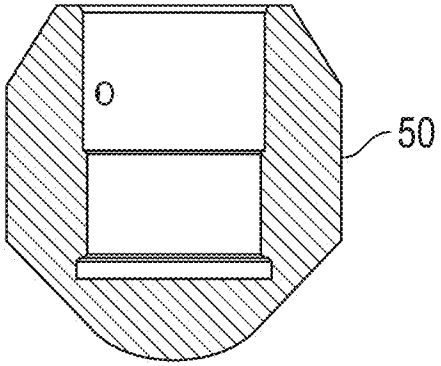
Figure 14:
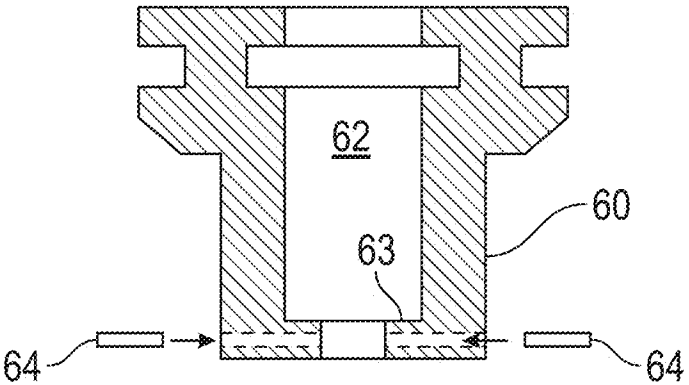
FIG. 14 is a cross section view of the flange.
Figure 16:
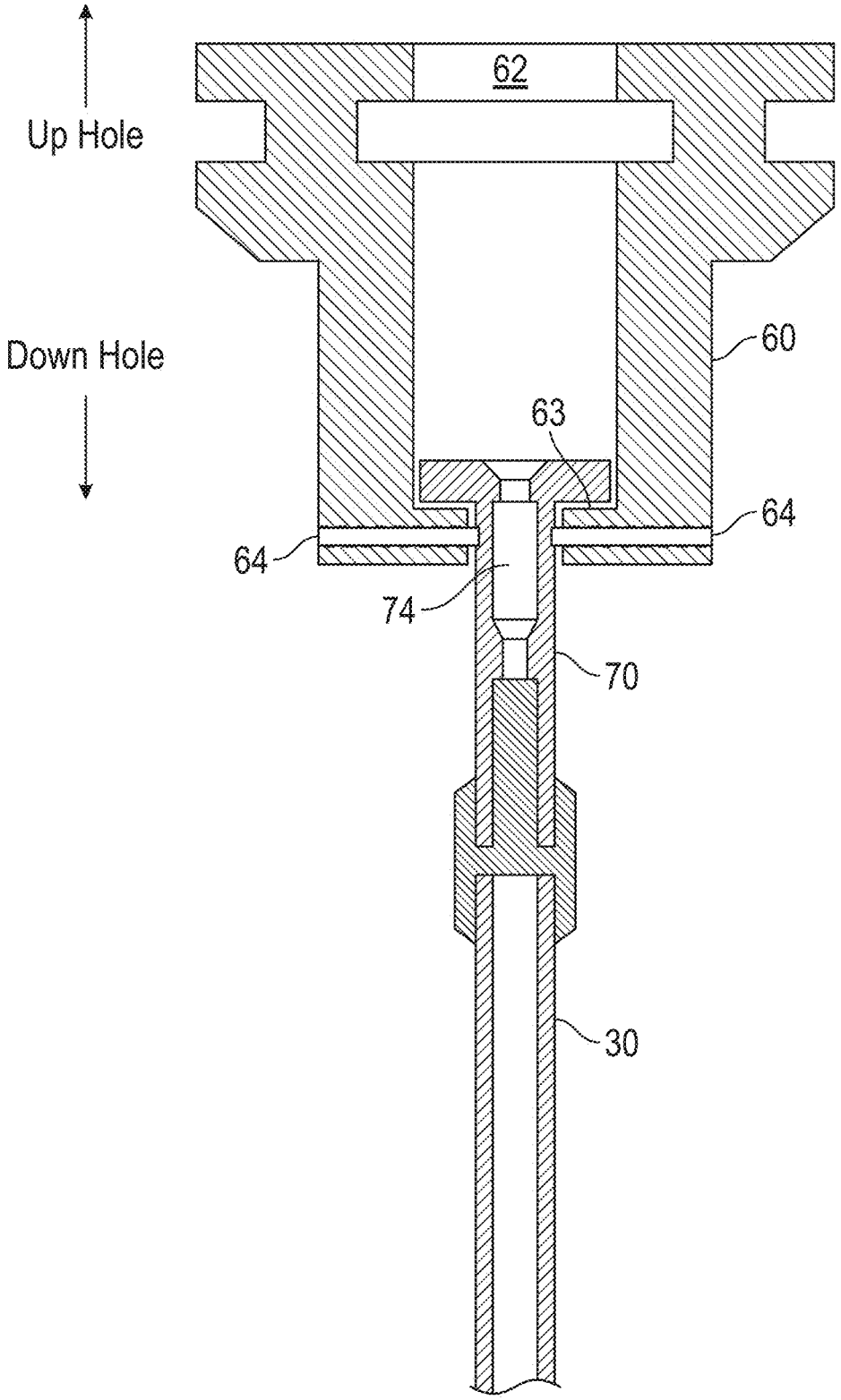
FIG. 16 is a cross section view of the retrieval element in place within the flange, with an exemplary filter chamber attached to the retrieval element.

Another embodiment of apparatus 10 may be described. Referring to FIGS. 14-16, the topmost element of apparatus 10, which in the previously described embodiment was bell housing 20, is flange 60. This embodiment may find particular suitability in smaller diameter tubular applications.

Flange 60 comprises bore 62 and an inner shoulder 63. A retrieval element 70 seats within flange 60, with an exterior shoulder 72 on retrieval element 70 resting on inner shoulder 63 within flange 60. A shear element 64, which can be shear pins, connects flange 60 and retrieval element 70. The remaining components (filter chambers, etc.) connect, via a threaded connection, to the downhole end of the retrieval element and extend downhole, and can be readily understood from the description of the preceding embodiment.

Retrieval element 70 comprises an internal profile 74, in which a fishing tool can latch. In the event that the filter chambers plug, a fishing tool can be deployed downhole, latch into internal profile 74, and with sufficient tension shear element 64 and retrieve retrieval element 70 and the connected filter chambers, etc. from the borehole.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof.

Therefore, the scope of the invention is to be determined not by the illustrative examples set forth above, but by the appended claims of and their legal equivalents.

I claim:

1. Apparatus, comprising:

a bell housing comprising an external tapered shoulder adapted to engage a mating internal shoulder within a tubular, said bell housing comprising a pressure relief component disposed therein, said pressure relief component comprising a rupture disk or a shear pin;

a filter chamber comprising an elongated cylinder comprising openings in a wall thereof further comprising a flow disperser cone element comprising a cone at an uphole end thereof, positioned within said elongated cylinder, said diverter cone oriented so that an apex of said cone points toward said uphole end of said apparatus and wherein said diverter cone diverts substantially all fluids and solids; and said filter chamber releasably connected to a downhole end of said bell housing by a threaded connection, wherein said apparatus comprises an uphole end and a downhole end, whereby fluids may flow through said apparatus from said uphole end toward said downhole end.

2. The apparatus of claim 1, wherein said filter chamber further comprises a plurality of diffuser blades positioned in said elongated cylinder, said diffuser blades extending into a bore of said elongated cylinder and oriented longitudinally in said bore.

3. The apparatus of claim 2, wherein said openings form elongated slots in said wall of said cylinder, and wherein a downhole end surface of said elongated slots is angled in a downhole direction, from an inner wall to an outer wall of said cylinder.

4. The apparatus of claim 3, further comprising a magnet mandrel releasably attached to a downhole end of said filter chamber by a threaded connection.

5. The apparatus of claim 4, wherein said magnet mandrel comprises a center core comprising a plurality of slots therein, a plurality of magnets disposed in said slots, and a non-magnetic outer sleeve disposed over said center core and said magnets, retaining said magnets in place.

6. The apparatus of claim 5, further comprising a connector attached to a downhole end of said magnet mandrel, said connector holding said outer sleeve in place, said connector dimensioned so as to provide a centralizing function to said apparatus within a borehole.

* * * * *